US008820982B2

(12) United States Patent
Chen

(10) Patent No.: US 8,820,982 B2
(45) Date of Patent: Sep. 2, 2014

(54) LAMPSHADE HAVING ADJUSTABLE DISTANCE BETWEEN TWO GRASP PORTIONS

(71) Applicant: Dafun Design Consultant Co., Ltd., Kaohsiung (TW)

(72) Inventor: Yu-Ta Chen, Kaohsiung (TW)

(73) Assignee: Dafun Design Consultant Co., Ltd., Kaohsiung (TW)

( * ) Notice: Subject to any disclaimer, the term of this patent is extended or adjusted under 35 U.S.C. 154(b) by 0 days.

(21) Appl. No.: 13/727,591

(22) Filed: Dec. 27, 2012

(65) Prior Publication Data

US 2013/0170227 A1 Jul. 4, 2013

(30) Foreign Application Priority Data

Dec. 28, 2011 (TW) ..... 100224823 A

(51) Int. Cl.

| | |
|---|---|
| ***F21V 7/00*** | (2006.01) |
| ***F21V 17/02*** | (2006.01) |
| ***F21V 17/06*** | (2006.01) |
| ***F21V 17/16*** | (2006.01) |
| ***F21V 17/10*** | (2006.01) |
| *F21V 1/02* | (2006.01) |
| *F21L 4/00* | (2006.01) |

(52) U.S. Cl.

CPC . *F21V 17/06* (2013.01); *F21V 1/02* (2013.01); *F21L 4/005* (2013.01); *F21V 7/0075* (2013.01); *F21V 17/164* (2013.01); *F21V 17/10* (2013.01)

USPC ..... 362/347; 362/191; 362/208; 362/449

(58) Field of Classification Search

CPC ..... F21V 17/06; F21V 7/10; F21V 17/04; F21V 17/164; F21V 7/0008; F21V 7/0075; F21V 1/02; F21V 1/08; F21L 4/005; F21L 4/04; F21L 4/045

USPC ..... 362/190, 191, 202, 208, 255, 256, 343, 362/433, 440, 441, 444, 449, 451, 341, 347

See application file for complete search history.

(56) References Cited

U.S. PATENT DOCUMENTS

| | | | | | |
|---|---|---|---|---|---|
| 1,698,912 | A * | 1/1929 | Hicks | 362/191 |
| 5,586,819 | A * | 12/1996 | Bamber et al. | 362/158 |
| 5,601,356 | A * | 2/1997 | McWilliams | 362/103 |
| 5,681,106 | A * | 10/1997 | Coultas et al. | 362/190 |
| 2007/0097676 | A1 * | 5/2007 | Chien | 362/202 |

* cited by examiner

*Primary Examiner* — Nimeshkumar Patel
*Assistant Examiner* — Steven Horikoshi
(74) *Attorney, Agent, or Firm* — Leong C. Lei

(57) ABSTRACT

A lampshade comprises a support seat, a reflector, and a cover. The support seat includes a frame and a clamping unit, the frame defining a central space, the clamping unit having two opposing connection bars attached to the frame and two grasp portions each being provided at one end of a corresponding connection bar. The distance between the two grasp portions is adjustable. The reflector is placed on top of the frame and has a reflective surface that can be fitted through the central space of the frame. The cover is placed on top of the reflector and fastened to the frame from a side opposite to the clamping unit. Accordingly, when a lighting device, such as a flashlight, is clamped by the lampshade, the light emitting from the lighting device can be reflected by the reflector to diffuse into the surrounding environment so as to increase the illuminating range.

4 Claims, 5 Drawing Sheets

LAMPSHADE HAVING ADJUSTABLE DISTANCE BETWEEN TWO GRASP PORTIONS

TECHNICAL FIELD OF THE INVENTION

The present invention relates to a lampshade that can work with an existing lighting device to diffuse the light emitting therefrom, so as to increase that the illuminating range.

DESCRIPTION OF THE PRIOR ART

Lighting device is a necessary equipment for daily home life, travel, or camping. Particularly, when engaging in an outside activity in night, a lighting device, which illuminates the surrounding environment, can increase the safety and convenience for the activity.

For example, when engaging in an outside activity in night, a general flashlight is usually taken to be hung to a tent's ceiling, so that it can emit light downwardly for providing illumination within the tent. However, the light beams emitting from a general flashlight are almost parallel, and thus the flashlight can only achieve illumination within a limited range and cannot achieve the demand of illuminating entire space within the tent.

In view of the foregoing, there is a need for improving the illumination for an existing lighting device. Based on long-term experiences and constant tests and innovations on lampshade products, the applicant has contrived a lampshade that can work with an existing lighting device to improve the illumination.

SUMMARY OF THE INVENTION

The primary object of the present invention is to provide a lampshade that can work with an existing lighting device to diffuse the light emitting therefrom, so as to increase the illuminating range.

To achieve the above object, the present invention discloses a lampshade, which comprises a support seat, a reflector, and a cover.

The support seat includes a frame and a clamping unit, the frame defining a central space, the clamping unit having two opposing connection bars attached to the frame and two grasp portions each being provided at one end of a corresponding connection bar, wherein the distance between the two grasp portions is adjustable.

The reflector is placed on top of the frame and has a reflective surface that can be fitted through the central space of the frame.

The cover is placed on top of the reflector and fastened to the frame from a side opposite to the clamping unit.

Accordingly, when a lighting device, such as a flashlight, is clamped by the lampshade, the light emitting from the lighting device can be reflected by the reflector to diffuse into the surrounding environment so as to increase the illuminating range.

Other objects, advantages, and novel features of the present invention will become more apparent from the following detailed description when taken in conjunction with the accompanying drawings.

DETAILED DESCRIPTION OF THE PREFERRED EMBODIMENTS

To allow the present invention to be fully understood, one embodiment according thereto will be illustrated with reference to the accompanying drawings in the following.

Figure 1:
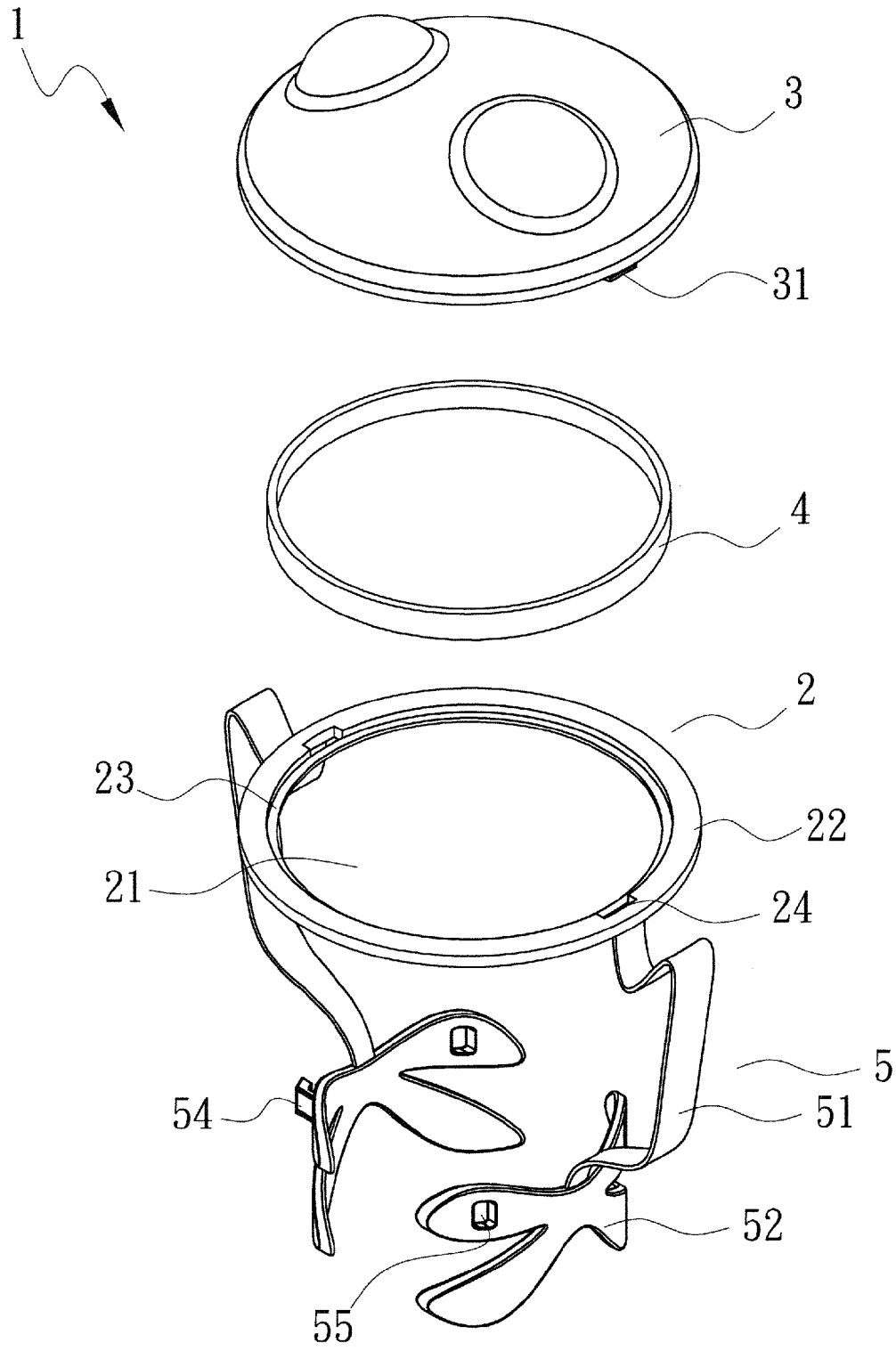
FIG. 1 shows an exploded view of one embodiment of the present invention.
Figure 2:
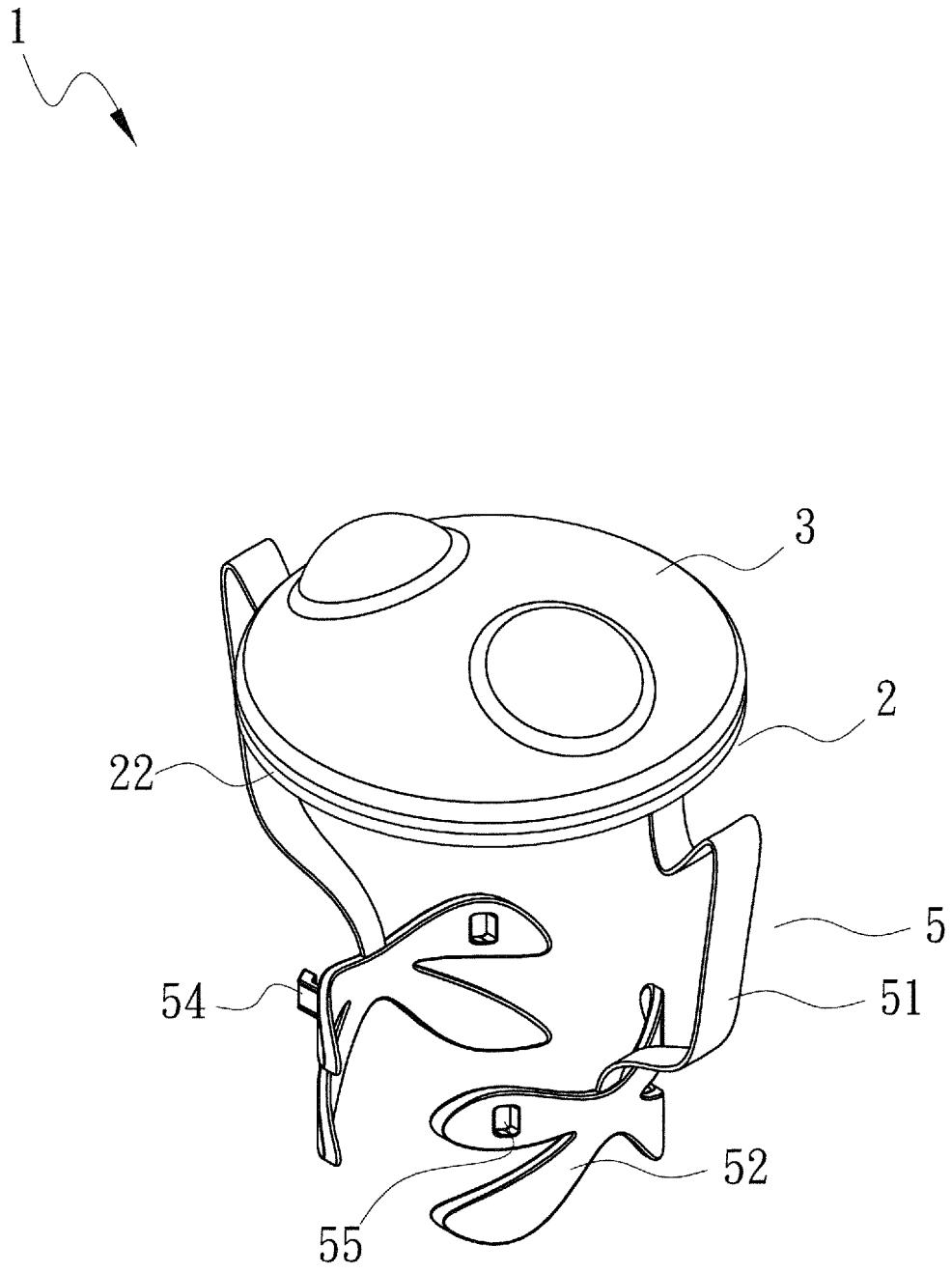
FIG. 2 shows a 3-dimensional view of the embodiment of the present invention.
Figure 3:
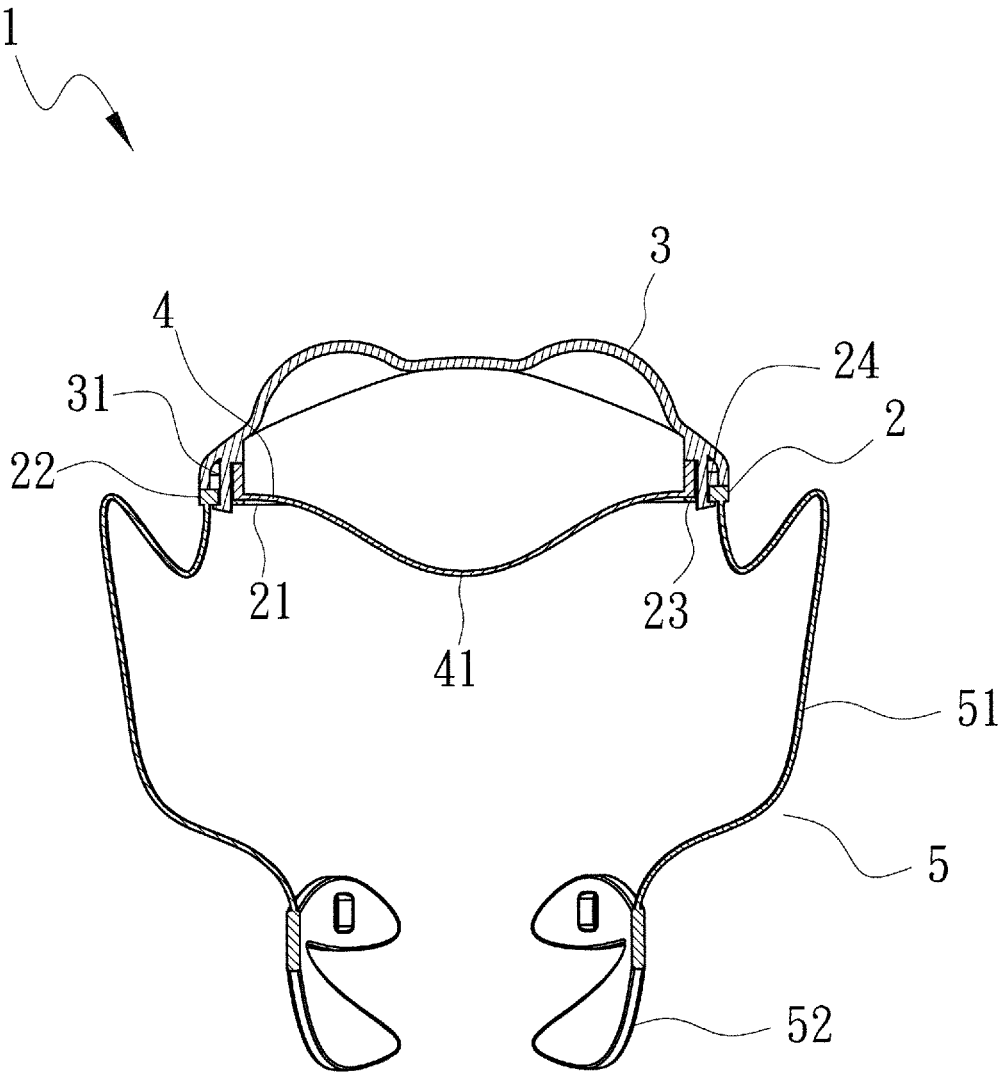
FIG. 3 shows a sectional view of the embodiment of the present invention.

Referring to FIGS. 1 to 3, a lampshade 1 according to one embodiment of the present invention is disclosed, which generally comprises a support seat 2, a cover 3, and a reflector 4, wherein the cover 3 can be fastened to the support seat 2, and the reflector 4 can be disposed between the cover 3 and the support seat 2.

The support seat 2 includes a frame 22 and a clamping unit 5. The frame 22 defines a central space 21, which is a through hole, and is provided with a flange 23 at a bottom thereof, which is at an exit of the central space 21.

The clamping unit 5 has two opposing connection bars 51 attached to the frame 22 and two grasp portions 52 each being provided at one end of a corresponding connection bar 51, wherein the connection bars 51 are made of flexible material, so that the grasp portions 52 associated therewith can be moved to adjust the distance therebetween.

The cover 3 can be formed to have a 3-dimensionally aesthetical shape, such as an animal or a cartoon figure. In the embodiment, the cover 3 is formed to look like a frog, however, this does not cause a limitation for the shape of the cover 3. In assembling, the cover 3 can be fastened to the frame 22 from a side opposite to the clamping unit 5.

The reflector 4, which has a curved reflective surface 41, is placed on top of the frame 22 to engage with the flange 23 of the frame 22, wherein the curved reflective surface 41 can be fitted through the central space 21 of the frame 22 from a side opposite to the clamping unit 5.

Furthermore, the cover 3 is provided with two downwardly extending hook portions 31 at two opposing locations, whereas the frame 22 defines two slots 24 corresponding to the hook portions 31. In assembling, the reflector 4 can be placed onto the frame 22 to engage with the flange 23 of the frame 22, and then the cover 3 can be placed from a position above the reflector 4 and fastened to the frame 22 by inserting the hook portions 31 of the cover 3 into the slots 24 of the frame 22 of the support seat 2.

Figure 4:
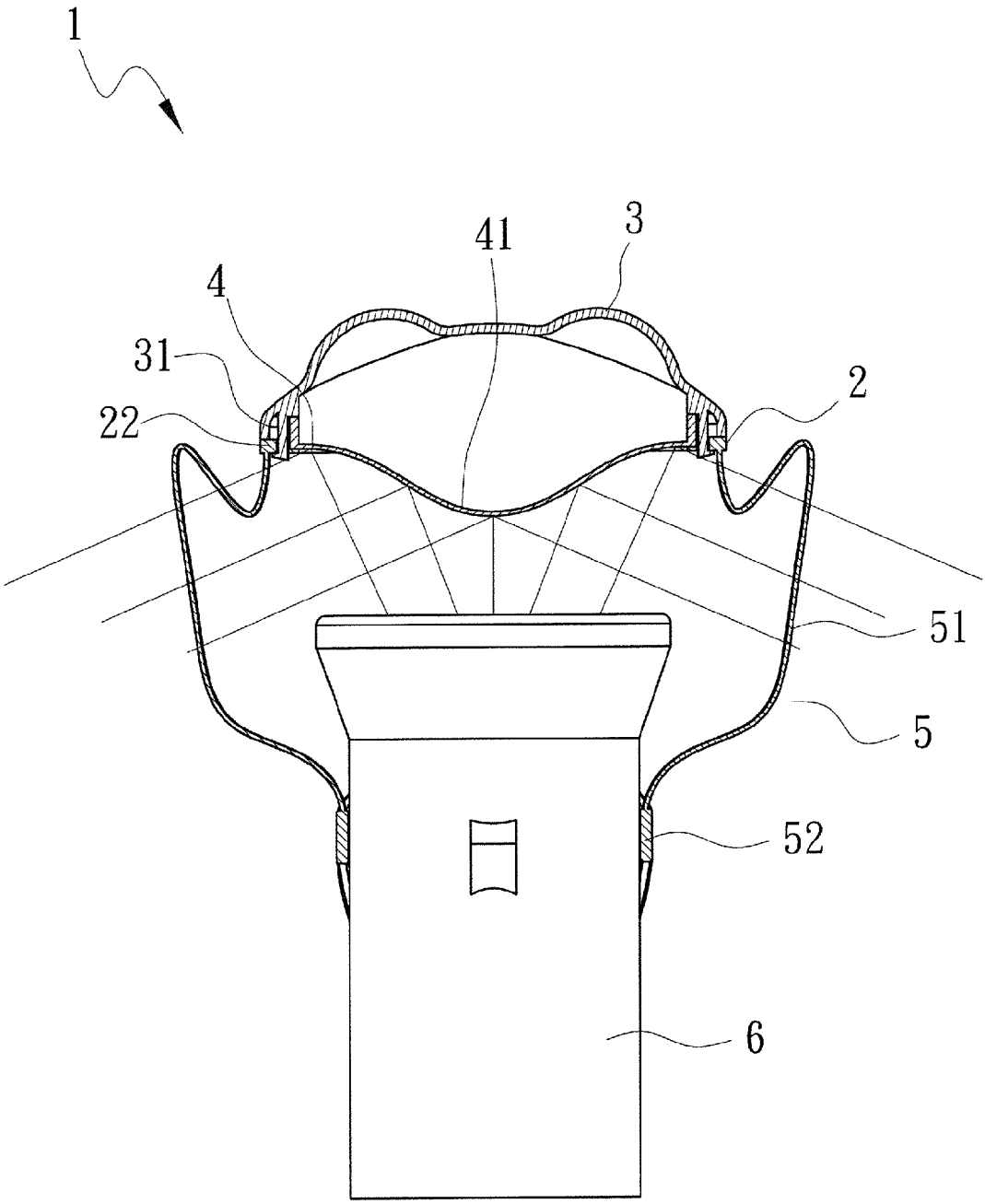
FIG. 4 shows a working view of the embodiment of the present invention, wherein the embodiment is employed to clamp a flashlight.

In use, as shown in FIG. 4, the grasp portions 52 can be fitted around a light device 6, such as a flashlight. Since the connection bars 51 is made of flexible material, the grasp portions 52 associated therewith can be moved to adjust the distance therebetween, so that the lighting device 6 can be clamped properly. With the lampshade 1, the reflector 4 can diffuse the light emitting from the light device 6 into the surrounding environment, so that the illuminating range can be increased.

Figure 5:
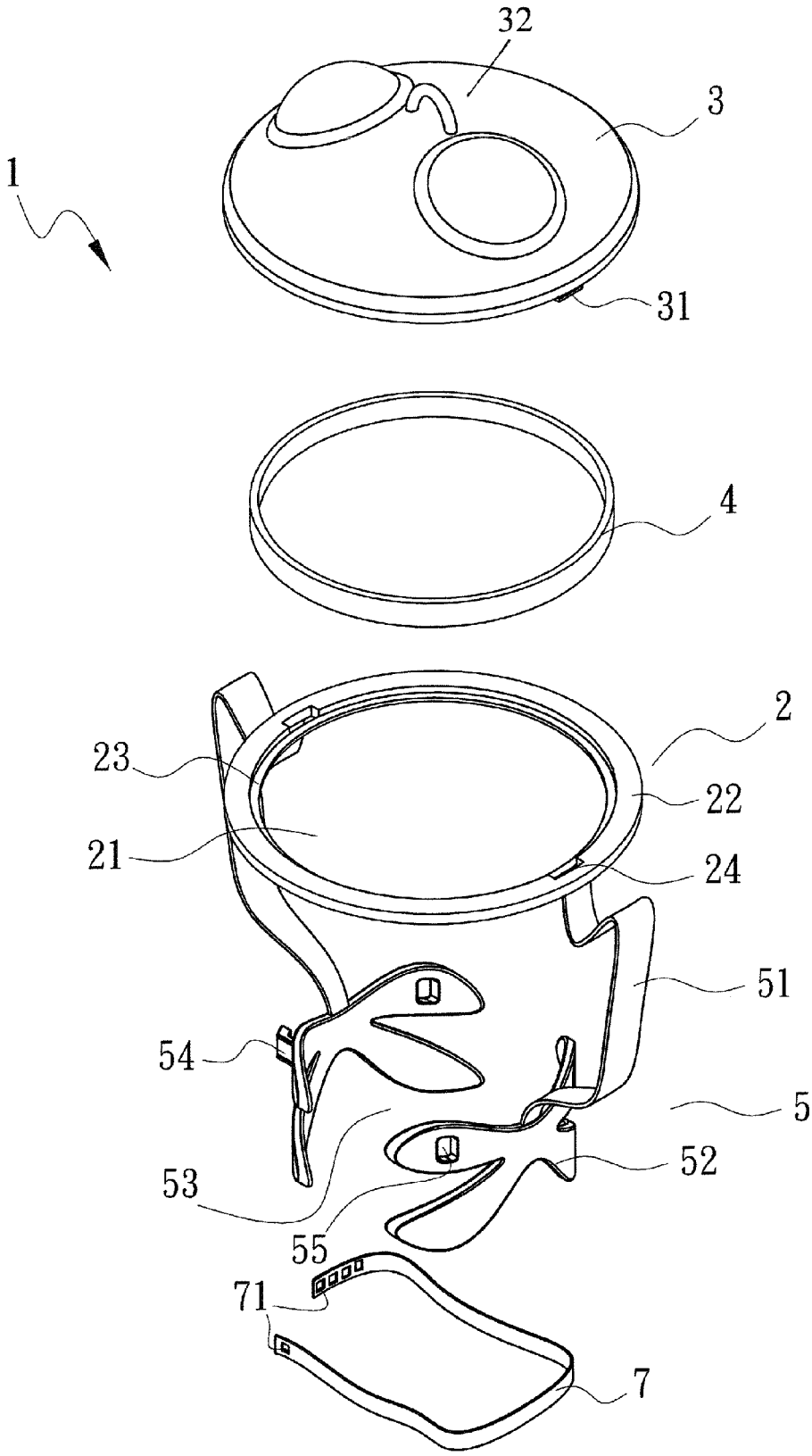
FIG. 5 shows another embodiment of the present invention.

Referring to FIG. 5, the lampshade 1 may further comprise a flexible tightening strap 7 defining a plurality of through holes 71, whereas the grasp portions 52 may be provided with a hooking element 54 and each with a through hole 55. Thereby, the flexible tightening strap 7 can cooperate with the grasping portions 52 of the clamping unit 5 to define a suitable holding space 53 therebetween, wherein the flexible tightening strap 7 can be inserted through the through holes 55 of the grasp portions 52, and the hooking element 54 of the grasp portions 52 can be engaged with one of the through holes 71 of the flexible tightening strap 7, according to the diameter of the handle of the flashlight 6, so that the lampshade 1 can clamp the flashlight 6 securely.

Furthermore, the cover 3 may be provided with a hanging portion 32 at a top thereof, which can facilitate the lampshade 1, together with the flashlight 6, to be hung on the ceiling of a tent for illumination.

As a summary, the present invention is a useful and innovative product, which has not been seen in the existing technology.

Although the present invention has been described with a certain degree of particularity, it is understood that the present disclosure is made by way of example only and the combination and arrangement of parts may be resorted to without departing from the spirit and scope of the invention hereinafter claimed.

I claim:

1. A lampshade, comprising:

a support seat including a frame and a clamping unit, the frame defining a central space, the clamping unit having two opposing connection bars attached to the frame so as to define circumferential open areas between the connection bars and two grasp portions each being provided at one end of a corresponding connection bar, wherein the distance between the two grasp portions is adjustable and the grasp portions are adapted to fit around a light device that emits a light beam of a first illuminating range;

a reflector being placed on top of the frame and having a curved reflective surface that is fitted through the central space of the frame and is spaced from and convexly protruding towards the light device in such a way that the curved reflective surface is adapted to receive the light beam from the light device and diffuse the light beam so that the diffused light travels through the circumferential open areas between the connection bars into the surrounding environment to cover a second illuminating range that is greater than the first illuminating range; and a cover being placed on top of the reflector and being fastened to the frame from a side opposite to the clamping unit.

2. The lampshade of claim 1, further comprising a flexible tightening strap that can cooperate with the grasping portions of the clamping unit to define a holding space therebetween.

3. The lampshade of claim 1, wherein the cover is provided with a hanging portion at a top thereof.

4. The lampshade of claim 1, wherein the cover is provided with at least one hook portion whereas the frame defines a slot corresponding to the hook portion, whereby the cover can be fastened to the frame by inserting the hook portion into the slot.

* * * * *